US006429598B1

(12) United States Patent
Haley

(10) Patent No.: US 6,429,598 B1
(45) Date of Patent: Aug. 6, 2002

(54) TRANSFORMER AND CONTROL UNITS FOR AC CONTROL

(76) Inventor: R. John Haley, 38 Vaan Drive, Nepean (CA), K2G 0C6

( * ) Notice: Subject to any disclaimer, the term of this patent is extended or adjusted under 35 U.S.C. 154(b) by 0 days.

(21) Appl. No.: 09/718,338

(22) Filed: Nov. 24, 2000

(51) Int. Cl.[7] ..... H05B 41/16

(52) U.S. Cl. ..... 315/141; 315/276; 315/288; 315/360; 323/355; 336/220; 361/622; 361/623

(58) Field of Search ..... 315/141, 200 R, 315/206, 209 R, 272, 276, 288, 291, 300, 307, 308, 360, 224, 225, 246, 282, 283; 307/17; 323/355; 336/220; 361/622, 623

(56) References Cited

U.S. PATENT DOCUMENTS

| | | | | |
|---|---|---|---|---|
| 4,051,425 A | * | 9/1977 | Smith | 323/24 |
| 4,151,515 A | * | 4/1979 | Pease et al. | 315/293 |
| 4,629,941 A | * | 12/1986 | Ellis et al. | 315/153 |
| 4,649,323 A | | 3/1987 | Pearlman et al. | 315/307 |
| 5,406,191 A | | 4/1995 | Salo | 323/370 |
| 5,581,449 A | | 12/1996 | Sridharan | 363/146 |

FOREIGN PATENT DOCUMENTS

GB 2115994 A 9/1983

OTHER PUBLICATIONS

"PICDIM Lamp Dimmer for the PIC12C508", © 1997 Microchip Technology Inc., from the web site www.microchip.com, identified as PICREF–4.

* cited by examiner

*Primary Examiner*—Don Wong
*Assistant Examiner*—Thuy Vinh Tran

(57) ABSTRACT

A transformer unit connects to an ac outlet and provides ac controlled by an opto-coupled triac to another ac outlet. The transformer unit includes a transformer and a third connector for connection to a control unit separate from the transformer unit. The third connector provides the control signal from the control unit, a low voltage supply for the control unit derived from the transformer, and the timing of the ac waveform, provided by a zero crossing signal or an ac or rectified ac signal which can constitute the low voltage supply. The control unit, electrically isolated from the ac supply, can produce the control signal under manual control or automatically to gradually change the conduction phase angle of the triac. The brightness of a lamp connected to the ac outlet is thereby controlled manually or automatically to provide a simulated dawn or dusk.

20 Claims, 4 Drawing Sheets

TRANSFORMER AND CONTROL UNITS FOR AC CONTROL

This invention relates to transformer and control units for ac (alternating current) control.

BACKGROUND OF THE INVENTION

There is a variety of known units which can be plugged into a conventional ac outlet to provide a source of controlled or modified power to a device connected thereto. Among these units are time switches, lamp dimmers, PLC (power line carrier) units which for example operate in accordance with the X-10 protocol, and transformer units which provide a relatively low voltage ac or dc supply for numerous types of electronic device. These units may be in the form of wall units with prongs which plug directly into an ac outlet, or in the form of floor or desk units with a supply cable having a plug which is plugged into an ac outlet. The term "plugged" as used herein is intended to embrace all forms of electrical connection to ac outlets, including for example screw-threaded and bayonet connections typically provided for lamps. The term "ac outlet" as used herein is intended to embrace both grounded (e.g. two-pin) and ungrounded (e.g. three-pin) outlets of any form, and includes an ac outlet provided at the end of a connection cable. The term "transformer unit" as used herein is intended to embrace both wall transformer units and floor or desk transformer units.

A time switch provides timed control for supply of ac power to an ac outlet on the time switch, or to an ac power output cable of the time switch. A lamp dimmer similarly provides controlled power to an ac outlet on the lamp dimmer unit or to a power output cable to which a lamp can be connected. The lamp dimmer provides for example a manual control of the conduction phase angle of a triac during each half cycle of the ac waveform, thereby controlling the brightness of the lamp. PLC units provide similar functions but can be remotely controlled, by commands sent by a PLC control unit via the ac power supply lines, to provide timed control and/or dimming control functions.

An X-10 PLC control unit (Radio Shack Home Control Center Computer Interface, Catalog No. 61-2417) is known which has prongs to plug it into an ac outlet, an ac outlet which is directly connected to the prongs, and a modular telephone cord connector providing an interface for connection to a computer. Within this unit, a transformer is connected to the prongs to supply low voltage power to PLC circuits of the unit. Software running on a connected computer enables PLC commands, including commands for timing and dimming functions, to be downloaded to the control unit, which subsequently sends these commands via the ac power lines without requiring continued connection or operation of the computer.

Transformer units which provide relatively low voltage supplies for electronic devices include numerous units for providing various individual or combinations of ac, unregulated dc, or regulated dc voltages at various currents and via various types of connector.

Every day, millions of people are awakened from sleep by a sudden noise, loud enough to wake the sleeper, from an alarm clock, clock radio, or similar device. It has been recognized that such a disruptive start to each day is undesirable, and that a more natural waking environment can be provided by a gradual increase in light, simulating dawn. Accordingly, various dawn/dusk simulators are known and for example are available from The SunBox® Co. (www.sunboxco.com) of Gaithersburg, Md. These units combine an analog or digital clock with a lamp, or an ac outlet for a lamp, whose brightness is controlled, the lamp being brightened at a desired time to simulate dawn or being dimmed at another desired time to simulate dusk. One of these units further provides sounds that get louder through a simulated dawn and quieter through a simulated dusk, as well as a conventional alarm sound. A disadvantage of such units is their relatively high cost, which makes them impractical for the vast majority of people, especially if such a unit is to be provided in each bedroom of a residence.

It is desirable, therefore, to provide a dawn simulator at a relatively low cost.

It can be appreciated that a dawn simulator comprises a timer, an automatically controlled lamp dimmer, and a lamp. Timers in the form of 24-hour time switches as discussed above are readily available at very low cost, and bedside plug-in lamps already exist in most bedrooms or are also easily provided. However, providing an automatically controlled lamp dimmer at low cost presents a more significant difficulty. For simulating dawn and waking a sleeper naturally, it is preferable for a lamp to be relatively close to the sleeper to provide an ultimately bright source of light, and it is necessary for the lamp to be turned on initially at a very low light level, and to be brightened smoothly over a period of time. Most common lamp dimmers do not allow a lamp to be turned on initially at a very dim level, and are not automatically controlled.

Using a PLC lamp module and a series of successive PLC commands over a period of time, it is possible to brighten a lamp from a dim level to a full brightness level in, for example, 16 brightness steps. However, the most commonly available PLC lamp modules do not permit the lamp to be initially turned on at anything other than its full brightness level, which is as disruptive to a sleeper as the sudden sound of an alarm clock. Although PLC lamp modules exist which obviate this problem, they are less readily available and are more costly. In any event, this solution also requires a PLC control unit, for example as discussed above, to issue the required series of PLC commands, as well as a computer from which to download the series of commands to the PLC control unit and the knowledge to set up, operate, and maintain this.

A need exists, therefore, for an effective dawn simulator that can be provided at low cost, and that does not require relatively sophisticated equipment and knowledge for its proper operation.

It is known that a low-cost microcontroller can be used to provide a lamp dimmer. For example, "PICDIM Lamp Dimmer for the PIC12C508", having a copyright date of 1997 and available from the web site (www.microchip.com) of Microchip Technology Inc. of Chandler, Ariz., where it is identified as PICREF-4, describes the use of a PICmicro® 8-bit microcontroller to provide zero crossing detection of an ac waveform and control of the conduction phase angle of a triac to provide manually controlled lamp dimming. Other documents on the same web site provide extensive further information on such microcontrollers and their applications, including for timing functions.

Microcontroller circuits typically have very small power requirements which are often met by using a transformerless ac power supply, an example of which is a capacitive power supply of the type shown in the PICREF-4 document. That document properly draws prominent attention to potential hazards of transformerless power supplies, namely that they present a potential risk because (especially with incorrect ac supply wiring or a malfunction) any part of the connected circuit may be at an ac supply voltage, and there is no transformer isolation for transients between the ac supply and the powered circuit. These potential hazards become of increasing significance in a lamp dimmer with manual switches which may be operated by a person who is not fully awake, and where transients are likely to be produced by the switching of the triac in each half cycle of the ac waveform. Although other protection measures are known for transformerless power supplies, these add complexity without fully avoiding all of the potential hazards. Thus the isolation advantages of a transformer power supply over-ride its disadvantages of bulk and cost, these disadvantages being of relatively low consequence in view of the low power requirements of a microcontroller.

SUMMARY OF THE INVENTION

The invention is concerned with addressing the need discussed above in a manner that facilitates providing a safe, versatile, practical, and economic solution.

According to one aspect, this invention provides a transformer unit comprising: a first connector for connection to an ac outlet to provide an ac supply to the transformer unit; a second connector constituting an ac outlet of the transformer unit; a triac, the first connector being coupled to the second connector via the triac to provide a controlled ac supply to the second connector; an electrically isolating coupler for coupling a control signal to the triac for controlling conduction of the triac; a transformer having primary and secondary windings, the primary winding being coupled to the first connector for receiving the ac supply; and a third connector comprising at least three wires for connection to a control unit separate from the transformer unit, said at least three wires providing said control signal from the control unit, a low voltage supply for the control unit derived from the secondary winding of the transformer, and an indication of the timing of a waveform of the ac supply.

In one form of the transformer unit, two of said at least three wires are coupled to the secondary winding of the transformer to provide an ac voltage constituting the low voltage supply for the control unit and the indication of the timing of the waveform of the ac supply. Another form of the transformer unit includes a rectifier, the secondary winding of the transformer being coupled to two of said at least three wires via the rectifier to provide a full wave rectified ac voltage constituting the low voltage supply for the control unit and the indication of the timing of the waveform of the ac supply.

A further form of the transformer unit includes a zero crossing detector arranged to provide a zero crossing signal representing zero crossings of the waveform of the ac supply and constituting said indication of the timing of the waveform of the ac supply. In this case conveniently the transformer unit can include a rectifier and smoothing circuit, the third connector comprising four wires and the secondary winding of the transformer being coupled to two of said four wires via the rectifier and smoothing circuit to provide a dc voltage constituting the low voltage supply for the control unit.

The invention also provides a control unit for connection to a transformer unit as recited above via the third connector of the transformer unit for providing said control signal to control a conduction phase angle of the triac in successive half cycles of the waveform of the ac supply, the control unit comprising a connector having at least three wires for coupling to the third connector of the transformer unit, and a control circuit powered by said low voltage supply and responsive to said indication of the timing of the waveform of the ac supply to produce said control signal.

Preferably the control unit includes at least one manual control for varying said control signal to vary the conduction phase angle of the triac, and conveniently the control circuit comprises a microcontroller. For operation as a simple dawn simulator, the control circuit is responsive to initial application of said low voltage supply to produce said control signal to determine a relatively large conduction phase angle of the triac for supplying relatively little power to a load connected to the second connector of the transformer unit, and subsequently to produce said control signal to gradually decrease said conduction phase angle of the triac thereby to gradually increase power supplied to said load. A more sophisticated control unit can include a display controlled by the microcontroller to constitute a clock.

Another aspect of the invention provides a transformer unit comprising: a first connector comprising prongs extending from an enclosure of the transformer unit for insertion into an ac outlet to provide an ac supply to the transformer unit; a second connector forming an ac outlet in the enclosure of the transformer unit; a triac controlled via an opto-coupler, the first connector being coupled to the second connector via the triac to provide to the second connector an ac supply controlled by a control signal supplied to the opto-coupler; a transformer having primary and secondary windings, the primary winding being coupled to the first connector for receiving the ac supply; and a third connector comprising at least three wires for connection to a control unit separate from the transformer unit, said at least three wires providing said control signal from the control unit, a low voltage supply for the control unit derived from the secondary winding of the transformer, and an indication of the timing of a waveform of the ac supply.

The invention further provides a control unit for connection to such a transformer unit via the third connector of the transformer unit for providing said control signal to control a conduction phase angle of the triac in successive half cycles of the waveform of the ac supply, comprising a connector having at least three wires for coupling to the third connector of the transformer unit, and a control circuit including a microcontroller powered by said low voltage supply and responsive to said indication of the timing of the waveform of the ac supply to produce said control signal.

A further aspect of the invention provides apparatus comprising: a first connector for connection to an ac outlet to provide an ac supply; a second connector constituting an ac outlet; a triac, the first connector being coupled to the second connector via the triac to provide a controlled ac supply to the second connector; an electrically isolating coupler for coupling a control signal to the triac for controlling conduction of the triac; a transformer having primary and secondary windings, the primary winding being coupled to the first connector for receiving the ac supply; a rectifier and smoothing circuit coupled to the secondary winding of the transformer for providing a dc voltage; a zero crossing detector arranged to produce a zero crossing signal representing zero crossings of a waveform of the ac supply; and a control circuit powered by the dc voltage and responsive to the zero crossing signal to produce said control signal to control a conduction phase angle of the triac in successive half cycles of the waveform of the ac supply; wherein at least the first and second connectors, the triac, the electrically isolating coupler, and the transformer are provided in a transformer unit, and at least the control circuit is provided in a control unit separate from the transformer unit for electrical connection to the transformer unit via a third connector having at least three wires, the control unit and the third connector thereby being electrically isolated from the ac supply.

Conveniently in such apparatus the control circuit comprises a microcontroller and is arranged to produce said control signal to determine a conduction phase angle of the triac which is automatically and gradually decreased from a relatively large initial value to a smaller subsequent value, thereby to supply initially relatively little power and subsequently a gradually increasing power to a load connected to the second connector, and the control circuit also includes at least one manual control to which the microcontroller is responsive for determining said control signal to vary the conduction phase angle of the triac.

Thus the invention is directed to transformer and control units, individually and in combination, of which the control unit is properly isolated from an ac power supply to which the transformer unit can be connected, the transformer unit serving to supply low voltage power to the control unit and to supply ac power controlled by a triac to an ac outlet, the triac being controlled by the control unit.

BRIEF DESCRIPTION OF THE DRAWINGS

The invention will be further understood from the following description by way of example of embodiments thereof with reference to the accompanying drawings, in which.

DETAILED DESCRIPTION

Figure 1:
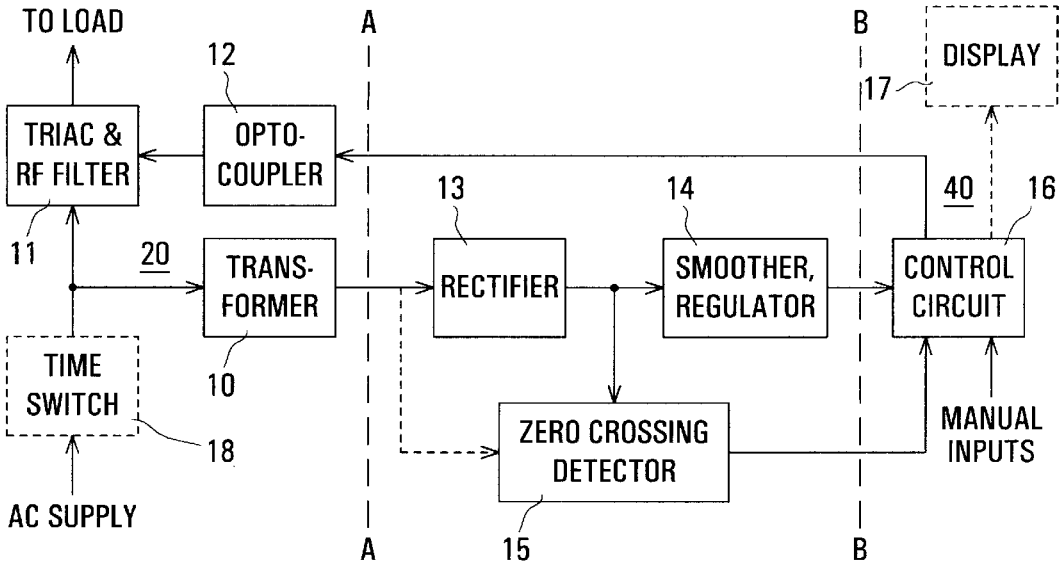
FIG. 1 is a block diagram illustrating an arrangement of transformer and control units for ac control in accordance with embodiments of the invention.

Referring to FIG. 1, an arrangement of transformer and control units for ac control in accordance with embodiments of the invention comprises a transformer 10, a triac 11, an opto-coupler 12, a rectifier 13, a smoother 14, a zero crossing detector 15, and a control circuit 16. Optionally, but in each case desirably, the triac 11 includes an RF interference filter, the smoother 14 includes a voltage regulator, and the control circuit 16 has manual inputs as illustrated in FIG. 1. The arrangement may optionally also include a display 17 shown in dashed lines, or it may be used with a 24-hour time switch 18 which is not a part of the arrangement but for convenience is also shown in dashed lines in FIG. 1.

At least the parts 10, 11, and 12 of the arrangement shown in FIG. 1 to the left of a vertical dashed line A—A are provided in a transformer unit 20 which can be plugged (via prongs on the unit, or via a cable, or otherwise connected, as discussed above) into an ac outlet, via the time switch 18 if this is present. The transformer unit 20 also includes an ac output connection for a load, typically a lamp whose brightness is to be controlled, conveniently in the form of an ac outlet on the unit, or on a cable extending from the unit. At least the control circuit 16 and its manual inputs, and the display 17 if this is present, of the arrangement shown in FIG. 1 to the right of another vertical dashed line B—B are provided in a control unit 40 which is separate from the transformer unit 20. The parts 13, 14, and 15 of the arrangement shown in FIG. 1 between the lines A—A and B—B can be provided in either the transformer unit 20 or in the control unit 40, or can be divided or provided between these units, as may be desired for example as further described below.

The transformer 10 and triac 11 are connected to the ac supply, optionally via the time switch 18, and the transformer 10 supplies a relatively low ac voltage to the rectifier 13. A rectified ac voltage produced by the rectifier 13 is supplied to the smoother and regulator 14, which provides a smoothed and regulated dc supply voltage to the control circuit 16. The zero crossing detector 15 is supplied with the rectified ac voltage from the rectifier 13 as shown in FIG. 1 by a solid line, or alternatively with the low ac voltage from the transformer 10 as shown in FIG. 1 by a dashed line, and produces a zero crossing signal which is supplied to the control circuit 16. The control circuit 16, which is responsive to the manual inputs as shown and is connected to and controls the display 17 if this is present, produces a conduction phase angle control signal which it supplies to the opto-coupler 12, which accordingly controls the conduction phase angle of the triac 11 in each half cycle of the ac waveform, and hence the brightness of the lamp connected as a load.

It can be appreciated that the transformer 10 and the opto-coupler 12 provide a complete isolation of the high voltage parts of the arrangement, which are all within the transformer unit 20, and the low voltage parts of the arrangement, including the control unit 20 and its manual inputs to the control circuit 16. A connection cable between the transformer and control units is also isolated from the high voltage parts of the arrangement, so that this cable can be conveniently provided in any desired manner. As described below, this connection cable can comprise three or four wires, so that it can be implemented in a particularly convenient manner by a four-wire telephone-type cable, readily available in various lengths and terminated by modular plugs. To this end, the transformer and control units can conveniently each include a modular socket for connection of the cable.

In an alternative arrangement, not illustrated, the zero crossing detector 15 can instead be responsive to the high voltage ac waveform. In this case, to preserve the complete isolation discussed above, at least the high voltage connections to the zero crossing detector 15 must be included in the transformer unit 20, and this detector must itself provide isolation of its output from its input; for example it may comprise an opto-coupler as described below with reference to FIGS. 8 and 9. While such an alternative arrangement can provide substantially more precise detection of the zero crossings of the ac waveform, this is not particularly desired for reasons explained later below.

In one simple embodiment of the invention, the display 17 is not provided. The transformer unit 20 in this embodiment is as described below with reference to FIGS. 2A, 2B, and 3, comprising the parts 10 to 13 of the arrangement of FIG. 1, and the control unit 40 is as described below with reference to FIGS. 4 and 5, comprising the control circuit 16, its manual inputs provided by two push button switches, the smoother and regulator 14, and the zero crossing detector 15. In this case the connection cable between the transformer and control units requires only three wires, and is conveniently provided by three of the four wires of a telephone type cable connected directly or via modular connectors as described above.

In this simple embodiment of the invention, for use as a dawn simulator the time switch 18 is provided and is set to supply power to the transformer unit 20 at a desired time, and a lamp is connected as the load. The control circuit 16 is responsive to power being initially supplied to it to produce the conduction phase angle control signal in successive half cycles of the ac waveform with an initially large phase angle (approaching 180°) so that the triac 11 controls the lamp to be dimly lit. The control circuit 16 then gradually, over a desired dawn simulation period of for example 30 minutes, reduces the phase angle of the control signal so that the brightness of the lamp is gradually increased to a full brightness level. The push button switches allow the brightness of the lamp to be manually controlled, for example to provide any desired brightness level of the lamp, or to restart the dawn simulation period. In the absence of the time switch 18, this embodiment of the invention provides a manually controllable light dimmer.

In another, more sophisticated, embodiment of the invention, the display 17 is provided and is controlled by the control circuit 16 in the manner of a digital clock, the control unit 40 thereby determining the time of day and the start time and length of the dawn simulation period (and optionally also a dusk simulation period). In this case the time switch 18 is not used, and the control circuit 16 provides all of the required timing functions of the arrangement as well as the control of the triac 11, and hence the lamp brightness, as described above. In this case the zero crossing detector 15 provides an accurate timebase for the clock, and a battery back-up can be provided in known manner.

Using a microcontroller in the control circuit 16 in each of the two embodiments of the invention outlined above, it can be appreciated that the power supply requirements of the latter are much greater because it adds the display 17, and this is particularly so if the display 17 uses LEDs (light emitting diodes). Accordingly, it may be preferred to include the smoother and regulator 14 of the arrangement in the control unit 40 rather than in the transformer unit 20, because its characteristics can then be adapted to the power supply requirements of the control unit.

Figure 2A:
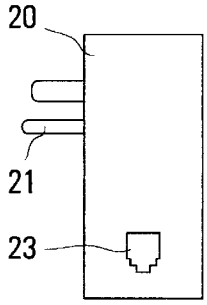
FIGS. 2A and 2B are side and face elevation views, respectively, of a transformer unit in accordance with an embodiment of the invention.
Figure 2B:
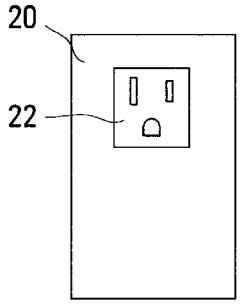

FIGS. 2A and 2B illustrate one form of the transformer unit 20, which comprises an enclosure of insulating material from one face of which prongs 21 extend to form, in this example, a three-pin plug for plugging into an ac outlet. An opposite face of the enclosure provides, in this example, a three-pin ac outlet 22 into which can be plugged a plug connected to a lamp whose brightness is to be controlled. In this example a side face of the enclosure includes a modular telephone socket 23 for connection of a cable to the control unit 40 as described above. Within the enclosure the transformer unit 20 is as described below with reference to FIG. 3.

Figure 3:
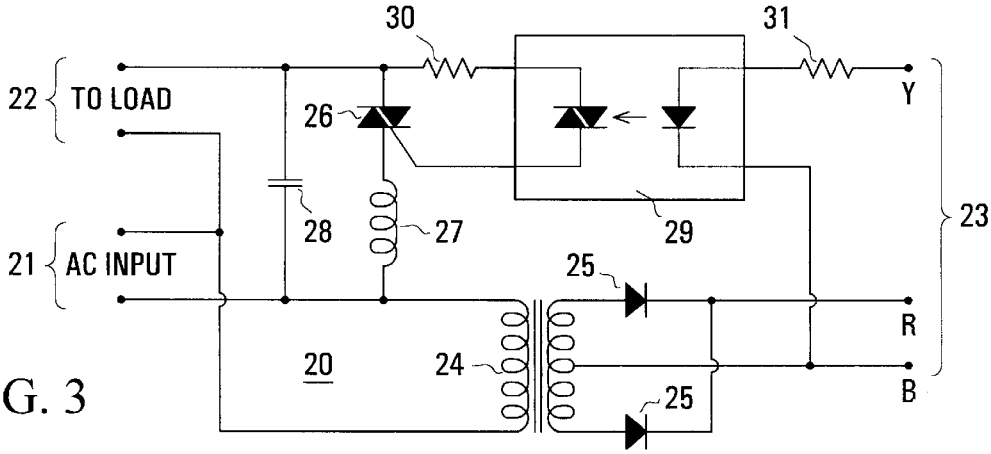
FIG. 3 is a circuit diagram of a transformer unit in accordance with an embodiment of the invention.

Referring to FIG. 3, the transformer unit 20 includes a transformer 24 having a primary winding connected to ac input terminals corresponding to two of the prongs 21 for live and neutral ac connections. A ground connection may also be provided but is not shown in FIG. 3. A secondary winding of the transformer is in this example center tapped, the center tap being connected to a terminal B and the two ends of the secondary winding being connected via respective rectifying diodes 25 to a terminal R. These terminals and a third terminal Y form connections of the socket 23, and for example correspond to the black, red, and yellow wires respectively of a four-wire telephone cable of which a green wire is in this case not used.

The live and neutral connections of the ac outlet 22, which may also include a ground connection not shown in FIG. 3, are connected via the controlled path of a triac 26 in series with an inductor 27, and via a capacitor 28 in parallel with the series circuit of the controlled path of the triac 26 and the inductor 27, to the ac input terminals. An opto-coupler 29 having a triac output has its output coupled via a resistor 30 to the triac 26 for triggering it in known manner, and has its input connected via a current limiting resistor 31 between the terminals Y and B of the socket 23.

It can be appreciated that the inductor 27 and the capacitor 28 constitute an RF interference filter, and with the triac 26 correspond to the triac and RF filter 11 of FIG. 1. The opto-coupler 29 and resistors 30 and 31 correspond to the opto-coupler 12 of FIG. 1. The transformer 24 and the diodes 25 correspond respectively to the transformer 10 and the rectifier 13 of FIG. 1. By way of example, the opto-coupler 29 and the triac 26 may be Motorola type MOC3012 and type 2N6071A devices respectively for an ac supply voltage of 120 volts, and the secondary winding of the transformer 24 may conveniently provide about 7 to 12 volts ac between each end and the center tap of the winding so that, relative to a zero voltage of the terminal B, the terminal R carries a full wave rectified ac voltage of about 9 to 16 volts peak.

Figure 4:
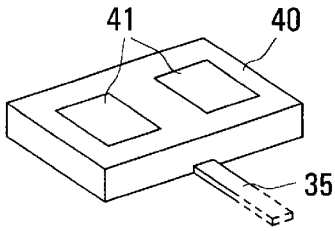
FIG. 4 is a pictorial view of a control unit for use with the transformer unit of FIG. 3.

FIG. 4 illustrates one form of the control unit 40, which comprises a relatively flat enclosure of insulating material an upper face of which includes two push buttons 41 for manual operation of respective switches as described below. For example, one of these push buttons can provide for lamp dimming, the other for lamp brightening, and combinations of push button operations can serve for other manual control functions. As shown in FIG. 4, a telephone-type cable 35 extends directly from the enclosure of the control unit 40 for connection to the transformer unit 20 as described above. Alternatively, the enclosure of the control unit 40 can include a modular socket for such a cable. Within its enclosure the control unit 40 is as described below with reference to FIG. 5. It can be appreciated that this form of the control unit 40 can be easily and conveniently positioned on a bedside table, attached (e.g. by adhesive tape) to a wall, or provided in place of a standard electrical light switch.

Figure 5:
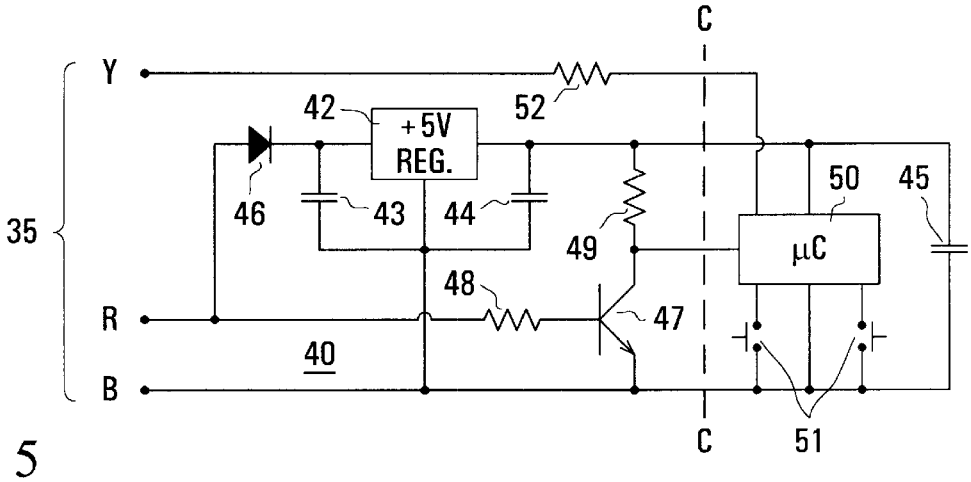
FIG. 5 is a circuit diagram of a control unit for use with the transformer unit of FIG. 3.

Referring to FIG. 5, the control unit 40 includes terminals Y, R, and B of the cable 35 to the transformer unit 20, and components corresponding to the parts 14 to 16 of the arrangement of FIG. 1. More particularly, the smoother and regulator 14 of FIG. 1 is constituted by a +5 volt regulator 42 having input, output, and common terminals, an input smoothing capacitor 43 connected between the input and common terminals, the common terminal being connected to the terminal B, an output filter capacitor 44 and a bypass capacitor 45 each connected between the output and common terminals, and a diode 46 coupling the terminal R to the input terminal of the regulator 42. The zero crossing detector 15 of FIG. 1 is constituted by an NPN transistor 47 having its emitter connected to the terminal B, its base connected via a resistor 48 to the terminal R, and its collector connected via a resistor 49 to the output terminal of the regulator 42 and providing a zero crossing output signal. The control circuit 16 of FIG. 1 is constituted by a programmed microcontroller ($\mu$C) 50 having 0 and +5 volt supply voltage terminals connected respectively to the terminal B and the output terminal of the regulator 42. The microcontroller 50 has three input terminals, one of which is connected to the collector of the transistor 47 to receive the zero crossing signal, the other two having internal pull-up resistors (not shown) and connected via respective normally open push button switches 51 to the terminal B. The push button switches 51 are closed by pressing the push buttons 41 described above with reference to FIG. 4. The microcontroller 50 also has an output terminal connected via a current limiting resistor 52 to the terminal Y.

It can be appreciated that, with the cable 35 interconnecting the transformer unit 20 and the control unit 40 as described above, the resistors 31 and 52 are connected in series with one another, and they can alternatively be replaced by a single resistor in either the transformer unit 20 or the control unit 40. However, the provision of the separate resistors 31 and 52 provides some degree of protection, for both the opto-coupler 29 in the transformer unit 20 and the microcontroller 50 in the control unit 40, in the event of extraneous voltages being applied to the terminal Y of either unit due to misconnection of the cable 35 or static electricity.

The control circuit 16 can also include circuitry, for example for power-on reset and brown-out protection of the microcontroller 50, for suppressing contact bounce of the push button switches 51, and for protecting the microcontroller 50 from static electricity during operation of the push button switches 51. Such circuitry is known in itself and for simplicity and clarity is not shown in FIG. 5.

By way of example, the regulator 42 can be a type 78L05 fixed positive voltage regulator. The microcontroller 50 can be a PIC12C508 device available from Microchip Technology Inc., using its internal oscillator and with inputs programmed to provide the pull-up resistors mentioned above.

Figure 6:
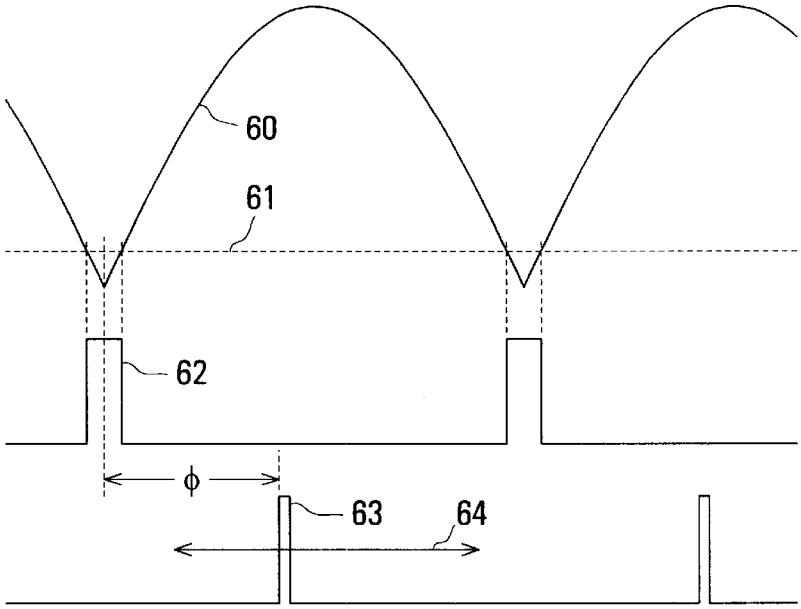
FIG. 6 is a diagram of waveforms produced in operation of the transformer unit of FIG. 3 and the control unit of FIG. 5.

In operation, with the transformer unit 20 supplied with ac power and connected via the cable 35 to the control unit 40, relative to a zero voltage of the terminals B the terminal R carries a full wave rectified ac voltage having a waveform as shown by a line 60 in FIG. 6. This is smoothed by the capacitor 43, the diode 46 serving to isolate the full wave rectified ac voltage from its smoothed counterpart, the smoothed voltage being regulated by the regulator 42 to provide a constant +5 volts at its output. When the rectified ac voltage exceeds a small positive threshold voltage, represented by a dashed line 61 in FIG. 6 and determined by the base-emitter junction voltage of the transistor 47, the transistor 47 conducts so that its collector is at a low level close to the zero voltage of the terminal B. When the full wave rectified ac voltage is less than the threshold voltage, i.e. close to and on each side of each zero crossing of the ac waveform which is rectified to produce the rectified ac voltage, the transistor 47 does not conduct and its collector is at a high level close to +5 volts. Consequently, the zero crossing signal produced at the collector of the transistor 47 is as shown by a line 62 in FIG. 6, with a pulse centered at each zero crossing of the ac waveform (each minimum of the full wave rectified ac voltage).

The microcontroller 50 is programmed as described below to produce, in each half cycle of the ac waveform, a pulse at its output starting at a controlled phase angle $\phi$ following the preceding zero crossing, as shown by a line 63 in FIG. 6. The width of each such pulse is sufficient to ensure triggering of the triac 26 via the opto-coupler 29, and for example can be 0.1 ms. A large phase angle, approaching 180°, corresponds to the lamp being very dimly lit, and progressively smaller phase angles correspond to increasing lamp brightness levels. In practice, the characteristics of an incandescent lamp have been found to be such that there is not a significant change in brightness for phase angles greater than about 160° (fully dim lamp) or less than about 30° (fully bright lamp), so that variation of the phase angle $\phi$ through a range from about 160° to about 30° is sufficient to change the lamp from fully dim to fully bright. This range is indicated approximately by a double-headed arrow 64 in FIG. 6.

Accordingly, it can be appreciated that the pulses of the zero crossing signal 62 can have a substantial width, without detracting from the brightness control of the lamp. In fact, a substantial width of each such pulse can be desirable, to facilitate execution by the microcontroller 50 of instructions during such pulses and thereby simplify its program as described further below, without producing a need for interrupts which the PIC12C508 device referred to above does not have. Accordingly, a width of about 0.5 to 1 ms for each pulse of the zero crossing signal 62 is convenient. As can be appreciated, for a 60 Hz ac waveform a zero crossing pulse width of 1 ms extends from a phase angle of about 169° in one half cycle to a phase angle of about 11° in the next half cycle, well outside the lamp brightness control range from about 30° to about 160° referred to above.

Figure 7:
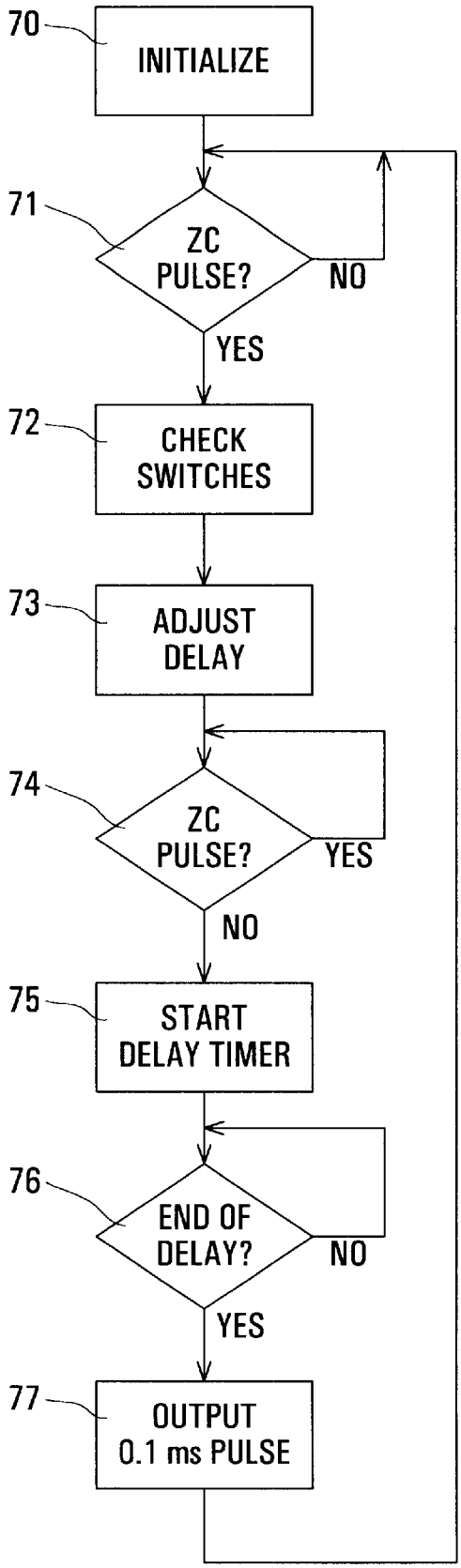
FIG. 7 is a flow chart illustrating operation of a microcontroller of the control unit of FIG. 5.

FIG. 7 is a flow chart, comprising function blocks 70 to 77, illustrating the operation of the programmed microcontroller 50. As illustrated by the block 70 in FIG. 7, on power being applied to the microcontroller it performs an initialization in which, among other things, a variable delay is set to a maximum value, measured from the end of the pulse of the zero crossing signal 62 (ZC pulse) at the start of the respective half cycle of the ac waveform, corresponding to a maximum phase angle, e.g. 160°, for an initially fully dim state of the lamp. As this delay depends on the width of the ZC pulse and the ac frequency (e.g. 50 or 60 Hz), this initialization may include a determination of the ac frequency and the ZC pulse width, the maximum value of the variable delay being determined accordingly.

In the block 71, the microcontroller determines whether a ZC pulse is present and, if not, loops to repeat this determination until a ZC pulse is present. Thus this constitutes a wait for the start of the next ZC pulse. In a subsequent block 72, during the ZC pulse, the microcontroller 50 checks the states of the push button switches 51 to determine whether either button 41 is pressed, and sets its operation according to any button presses. For example, in response to pressing either button 41 the microcontroller may switch from an initial automatic lamp brightening (simulated dawn) mode to a manual dimming control mode and control the lamp brightness accordingly, and in response to pressing both buttons 41 and releasing them separately the microcontroller may switch from the manual control mode back to an automatic mode in which the lamp is gradually brightened (simulated dawn) or is gradually dimmed (simulated dusk) from its current brightness level, depending on the order in which the buttons 41 are released. Other button control functions can be provided similarly or otherwise as desired.

In the subsequent block 73, the microcontroller adjusts the variable delay, which determines the brightness of the lamp. In the automatic modes, this delay is gradually reduced or increased, at a desired rate over many half cycles of the ac waveform, to provide a simulated dawn or dusk respectively. In the manual mode this delay adjustment is dependent upon continued pressing of either of the buttons 41.

Following the block 73 the microcontroller waits, as shown by the looped block 74, for the end of the ZC pulse. As indicated above, the width of each ZC pulse is sufficient that all of the processes of the blocks 72 and 73 can be completed during each ZC pulse, thereby simplifying the program of the microcontroller 50 and facilitating use of a microcontroller which does not have any interrupt capability.

On detection of the end of the ZC pulse, in the block 75 the microcontroller starts a delay timer for timing the variable delay determined as described above, and then, as shown by the looped block 76, waits for the end of this delay. The microcontroller then, as shown by the block 77, outputs a pulse of 0.1 ms duration constituting its output as shown by the line 63 in FIG. 6, and returns to the block 71 to wait for the next ZC pulse. These processes are repeated in successive half cycles of the ac waveform.

The operation of the microcontroller 50 can be modified and expanded from that described above, for example to provide a flashing of the lamp and/or an audible alarm after the full brightness of the lamp is reached at the end of a simulated dawn. In addition, other types of microcontroller can be provided for more sophisticated functions, such as for operating the optional display 17 as a clock, with settings dependent upon the operation of further manual inputs to the microcontroller 50. As indicated above, in the latter case the time switch 18 of FIG. 1 is not required and instead the timing of a simulated dawn (or dusk) can be determined by the microcontroller 50 and displayed using the display 17. This also provides the advantage that the lamp can be turned on and its brightness controlled at any time, independently of the state of a separate time switch.

Referring again to FIGS. 3 and 5, it can be appreciated that these illustrate only one possible form of various parts of the arrangement of FIG. 1, and numerous alternatives for these can be used. For example, instead of the opto-coupler 29, resistor 30, and triac 26 being provided as shown in FIG. 4 to constitute the opto-coupler 12 and triac 11 of FIG. 1, a triac with a direct opto-coupled input can be used. Instead of the transformer 24 with a center tapped secondary and a full wave rectifier provided by the diodes 25 as shown in FIG. 4, the transformer can have an untapped secondary winding and a half wave or bridge rectifier can be used. In addition, different forms of zero crossing detector can be provided. Further, other forms can be used for the various other parts of the arrangement of FIG. 1.

Some possible variations are described by way of example below with reference to FIGS. 8 to 10, in which similar references to those used above are used where appropriate to denote similar elements. Each of these figures only illustrates the transformer and, between the dashed lines A—A and B—B as in FIG. 1, the rectifier, smoother and regulator, and zero crossing detector, corresponding to the parts 10 and 13 to 15 of the arrangement of FIG. 1. In each case these components are all provided in the transformer unit 20, or are divided between the transformer unit 20 and the control unit 40, in the manner described above with reference to FIG. 1.

Figure 8:
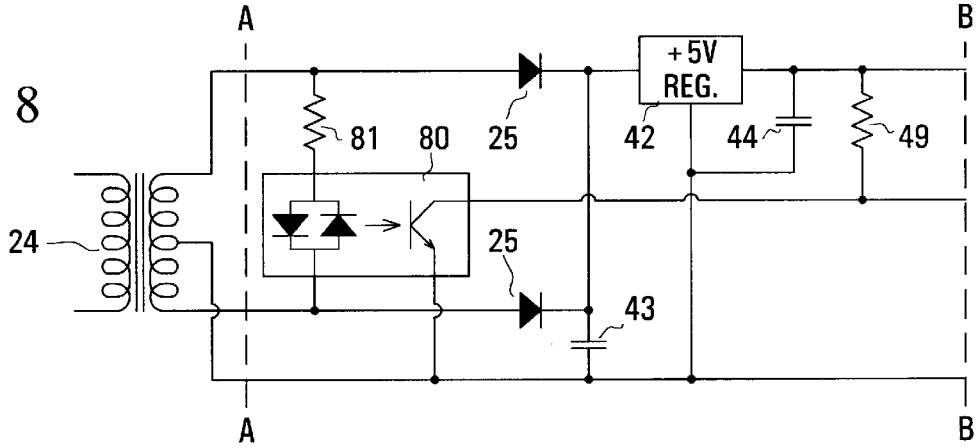
FIGS. 8 to 10 are circuit diagrams showing alternative circuits of parts of the transformer and control units.

In the circuit of FIG. 8, the transformer 24, diodes 25, regulator 42, and capacitors 43 and 44 are provided as in the circuits of FIGS. 3 and 5, except that the diode 46 of FIG. 5 is not present because it is not required. The zero crossing detector in the circuit of FIG. 8 is constituted by an ac opto-coupler 80 having an NPN transistor output, parallel oppositely poled input LEDs of the opto-coupler 80 being connected in series with a resistor 81 between the ends of the secondary winding of the transformer 24. The transistor output of the opto-coupler 80 has an emitter connected to the center tap of the transformer secondary winding and a collector connected via the resistor 49 to the output of the regulator 42 and providing the zero crossing signal, in a similar manner to the transistor 47 in the circuit of FIG. 5. The circuit of FIG. 8 can provide relatively narrow ZC pulses because the opto-coupler 80 is supplied via the resistor 81 with the relatively high ac voltage between the ends of the transformer secondary winding.

The circuit of FIG. 8 has the advantage of eliminating the diode 46 of the circuit of FIG. 5, and requires a four-wire connection cable 35 between the transformer and control units. For example, the cable 35 can be provided at the dashed line B—B, the four wires providing the triac conduction phase angle control signal (the wire for which is not shown in FIG. 8), the zero crossing signal, and the zero and +5 V voltages constituting a dc supply voltage for the control unit 40. Alternatively, for example the cable 35 can carry the smoothed but unregulated dc supply voltage instead of the regulated voltage, the regulator 42 and the capacitor 44 being provided in the control unit 40. As a further alternative, all of the components of the circuit of FIG. 8, except for the transformer 24, can be provided in the control unit 40, the cable 35 having three of its wires connected to the ends and center tap of the secondary winding of the transformer at the dashed line A—A, thereby providing an ac supply voltage for the control unit 40 which inherently provides the timing of the ac waveform.

Figure 9:
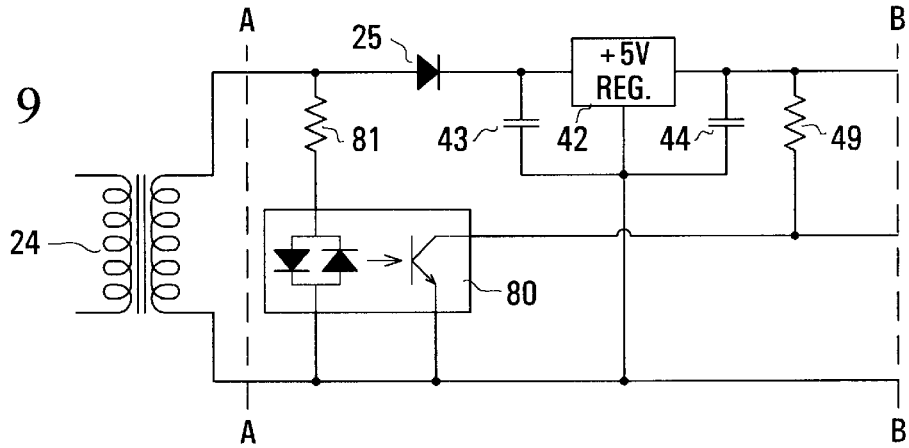

The circuit of FIG. 9 similarly uses an ac opto-coupler 80 and resistor 81 in conjunction with the resistor 49 to provide the zero crossing detector, and the components 42 to 44 are provided in the same manner. In the circuit of FIG. 9, the transformer 24 has an untapped secondary winding, and a single diode 25 is provided as a half wave rectifier. With the circuit of FIG. 9 a three-wire cable 35 can be used if all the components except the transformer 24 are in the control unit 40, i.e. if the cable 35 is connected at the dashed line A—A. Otherwise this circuit requires a four-wire connection cable 35 between the transformer and control units, one of the three wires shown in FIG. 9 providing the zero crossing signal, and the other two providing either the regulated DC supply voltage at the dashed line B—B, the smoothed but unregulated dc supply voltage at the input terminal of the regulator 42, or the ac voltage before rectification by the diode 25.

It can be appreciated that in the circuit of FIG. 9 the opto-coupler 80 can instead be coupled via the resistor 81 to the ac supply on the primary winding side of the transformer 24, these components 80 and 81 then necessarily being in the transformer unit 20 to, maintain the isolation of the cable 35 and the control unit 40 from high voltages.

Figure 10:
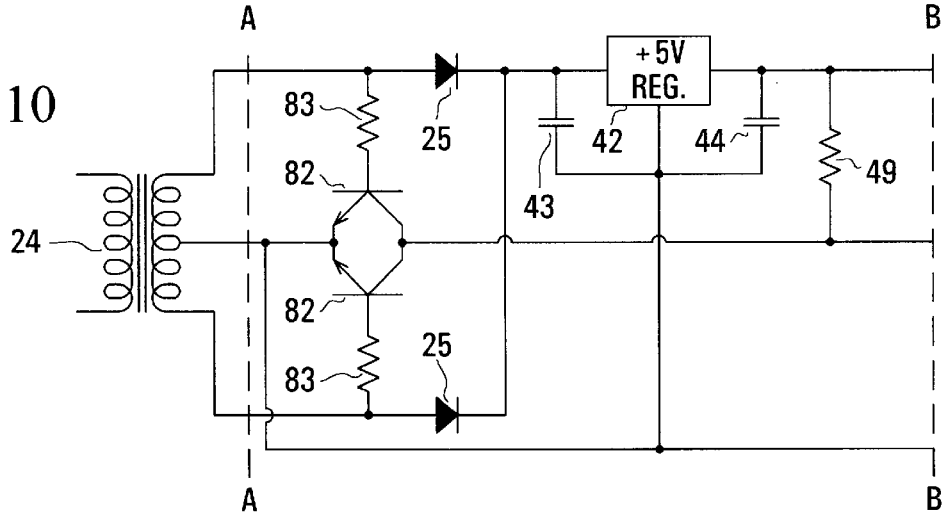

The circuit of FIG. 10 is similar to that of FIG. 8, except that the opto-coupler 80 and the resistor 81 in the circuit of FIG. 8 are replaced in the circuit of FIG. 10 by two NPN transistors 82 and two resistors 83. The transistors 82 have their emitters connected together and to the center tap of the secondary winding of the transformer 24, their collectors connected together and to the resistor 49 to provide the zero crossing signal, and their bases each connected via a respective one of the resistors 83 to a respective end of the secondary winding of the transformer 24. This circuit also requires a four-wire connection cable 35 between the transformer and control units, the wires of the cable conveniently being connected in any of the ways described above with reference to FIG. 8.

From the above description it can be seen that the connection cable 35 between the transformer and control units can have at least three or four wires. One of these wires, corresponding to the terminal Y in FIGS. 3 and 5, in each case provides a variable phase pulse of the control signal, in each half cycle of the ac waveform, which determines the conduction phase angle of the triac and hence the power supplied to a connected load. Another two of the wires, corresponding to the terminals B and R in FIGS. 3 and 5, provide a low voltage supply for the control unit. In the embodiment of the invention described with reference to FIGS. 3 and 5, this is a full wave rectified ac voltage which also provides information as to the timing of each zero crossing of the ac waveform. It can alternatively be a low voltage ac waveform from the secondary winding of the transformer 24, also providing both a power supply for the control unit and information as to the timing of each zero crossing of the ac waveform, as in the three-wire arrangement of the circuit of FIG. 9 as described above. Thus in these cases only a three-wire connection cable 35 is required.

In four-wire connection cable arrangements, for example as described above with reference to FIGS. 8 to 10, in addition to the wire for the triac control signal, two of the wires provide a low voltage supply for the control unit, and this may be an ac, rectified ac, unregulated dc, or regulated dc voltage, and the remaining wire carries information as to the timing of each zero crossing of the ac waveform, for example in the form of the ZC pulses produced at the output of the opto-coupler 80 or at the collectors of the transistors 82. It can be appreciated that the connection cable 35 can alternatively have a greater number of wires to provide the same functions.

Although any of these various arrangements can be provided, the three-wire connection arrangement of the circuits of FIGS. 3 and 5 is presently preferred because it only requires three wires, so that a fourth wire need not be provided in the cable 35 or, if present, can be used for another purpose, and because it enables the zero crossing detector to be provided in the control unit 40 where the ZC pulses are used. This enables the form of the zero crossing detector, and hence for example the width of ZC pulses, to be determined as may be desired in conjunction with the manner in which the zero crossing signal will be used by the control circuit. In addition, this arrangement isolates the input terminal of the microcontroller 50 to which the ZC pulses are applied from the cable 35, thereby reducing risk of damage due to static electricity or misconnection of the cable. Further, this arrangement provides a rectified ac power supply output, enabling it to be distinctly distinguished from conventional transformer units providing either ac or dc outputs. In addition, this arrangement enables different forms of smoother and regulator to be provided in the control unit 40, as may be required by the control unit for example to meet different current requirements depending upon the presence and type, or absence, of the optional display 17. Although this arrangement is described above in the context of the transformer 24 having a center tapped secondary winding and using two diodes for full wave rectification, substantially the same result can be provided by an untapped secondary winding and a diode bridge for full wave rectification.

Although a microcontroller can provide a particularly economical and convenient implementation of the control circuit 16, other forms of control circuit can be provided. For example, the control circuit can instead be in the form of a digital logic circuit comprising gates and counters, with the count of an up-down counter being used to provide the variable delay for determining the conduction phase angle of the triac. Alternatively, an analog circuit can be used to form the control circuit 16, with the voltage of an integrator being compared to a variable threshold voltage to determine the conduction phase angle of the triac.

Figure 11:
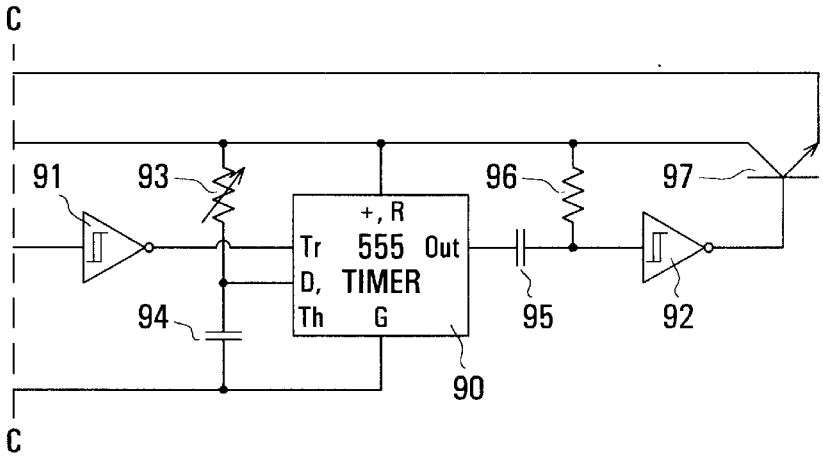
FIG. 11, which is on the same sheet as FIGS. 5 and 6, shows an alternative circuit for part of the control unit of FIG. 5.

In addition, although embodiments of the invention have been described above in the context of providing a simulated dawn with automatic brightening of a controlled lamp, the invention is not limited to this application. Instead, for example, the transformer and control units can be provided in place of a conventional manually controlled lamp dimmer, providing the advantage of a full range of control of the lamp brightness. Such an application corresponds to the manual mode of operation of the microcontroller 50 as described above. In this case the control circuit 16 can alternatively be provided by a circuit for example as shown in FIG. 11. As indicated by vertical dashed lines C—C in FIGS. 5 and 11, the circuit of FIG. 11 is intended to replace the microcontroller 50, switches 51, and capacitor 45 of the circuit of FIG. 5. Referring to FIG. 11, the circuit illustrated therein comprises a type 555 timer integrated circuit (IC) 90 of well-known form, two inverters 91 and 92, for example type 74C14 devices having Schmitt trigger input circuits, a variable resistor 93 and a capacitor 94 forming a variable timing circuit for the timer IC 90, a capacitor 95 and a resistor 96 forming a differentiator, and an NPN transistor 97. The timer IC 90 has its positive voltage supply (+) and reset (R) inputs connected to the +5 volt regulated voltage line connected to the output terminal of the regulator 42, its ground (G) input connected to the 0 volt line connected to the common terminal of the regulator 42, its trigger (Tr) input connected to the output of the inverter 91, its discharge (D) and threshold (Th) inputs connected via the variable resistor 93 to the +5 volt line and via the capacitor 94 to the 0 volt line, and its output (Out) connected via the capacitor 95 to the input of the inverter 92. The resistor 96 is connected between the input of the inverter 92 and the +5 volt line, and the transistor 97 has its base connected to the output of the inverter 92, its collector connected to the +5 volt line, and an emitter load formed by the resistor 52 (FIG. 5) in series, via the connection cable 35, with the resistor 31 and input diode of the opto-coupler 29 (FIG. 3).

In operation of the circuit of FIG. 11, each positive-going ZC pulse as shown in FIG. 6 is supplied to the input of the inverter 91 to provide a negative-going pulse to the trigger input of the timer IC 90, which consequently produces a positive-going pulse at its output, starting with the start of the ZC pulse and ending after a variable time delay determined by the resistance of the variable resistor 93 and the capacitance of the capacitor 94. The falling edge of the positive-going output pulse of the timer IC 90 is differentiated by the differentiator circuit formed by the capacitor 95 and the resistor 96 to produce a negative-going spike at the input of the inverter 92. This is inverted by the inverter 92 to produce a positive-going pulse at its output, the capacitor 95 and resistor 96 being selected so that this pulse has a duration of about 0.1 ms. This pulse is supplied via the transistor 97, which provides current gain, as an output pulse to the opto-coupler 29 (FIG. 3). This output pulse has a phase angle corresponding to the variable time delay referred to above. For a 60 Hz ac waveform, a 10 kΩ linearly variable resistor 93 and a 1 $\mu$F capacitor 94 can provide the phase angle range from about 30° to about 160° as discussed above. Thus the circuit of FIG. 11, in conjunction with the other parts of the control unit 40 and the transformer unit 20, provides a convenient manually operable lamp dimmer.

Although as described above the conduction phase angle control signal is coupled to the triac via an opto-coupler which provides isolation from the high voltages controlled by the triac, a pulse transformer or other isolating coupling can instead be used to provide the desired electrical isolation and signal coupling. Further, although as described above the triac is controlled to determine its conduction phase angle in each half cycle of the ac waveform as is desired for brightness control of a lamp, especially for other types of load the triac can instead be controlled to conduct for part or all of some but not all of the successive half cycles of the ac waveform to provide a controlled ac output to the load.

Although a triac is provided in the transformer unit as described above, it should be appreciated that this term is intended also to embrace other controlled devices having an equivalent function, for example two thyristors or semiconductor controlled rectifiers (SCRs) connected in parallel with one another with opposite polarities, or a single SCR connected in a diagonal of a diode bridge, and the term "triac" as used herein should be interpreted accordingly.

Thus although particular embodiments of the invention have been described above, it can be appreciated that the alternatives discussed above and numerous other variations, modifications, and adaptations may be made within the scope of the invention as defined in the claims.

What is claimed is:

1. A transformer unit comprising:

a first connector for connection to an ac outlet to provide an ac supply to the transformer unit;

a second connector constituting an ac outlet of the transformer unit;

a triac, the first connector being coupled to the second connector via the triac to provide a controlled ac supply to the second connector;

an electrically isolating coupler for coupling a control signal to the triac for controlling conduction of the triac;

a transformer having primary and secondary windings, the primary winding being coupled to the first connector for receiving the ac supply; and a third connector comprising at least three wires for connection to a control unit separate from the transformer unit, said at least three wires providing said control signal from the control unit, a low voltage supply for the control unit derived from the secondary winding of the transformer, and an indication of the timing of a waveform of the ac supply.

2. A transformer unit as claimed in claim 1 wherein the first connector comprises prongs extending from an enclosure of the transformer unit for insertion into an ac outlet.

3. A transformer unit as claimed in claim 2 wherein the second connector comprises an ac outlet in the enclosure of the transformer unit.

4. A transformer unit as claimed in claim 1 wherein the electrically isolating coupler comprises an opto-coupler.

5. A transformer unit as claimed in claim 1 wherein two of said at least three wires are coupled to the secondary winding of the transformer to provide an ac voltage constituting the low voltage supply for the control unit and the indication of the timing of the waveform of the ac supply.

6. A transformer unit as claimed in claim 1 and including a rectifier, the secondary winding of the transformer being coupled to two of said at least three wires via the rectifier to provide a full wave rectified ac voltage constituting the low voltage supply for the control unit and the indication of the timing of the waveform of the ac supply.

7. A transformer unit as claimed in claim 1 and including a zero crossing detector arranged to provide a zero crossing signal representing zero crossings of the waveform of the ac supply and constituting said indication of the timing of the waveform of the ac supply.

8. A transformer unit as claimed in claim 7 wherein the zero crossing detector comprises an opto-coupler having an input coupled to a winding of the transformer.

9. A transformer unit as claimed in claim 7 and including a rectifier and smoothing circuit, wherein the third connector comprises four wires and the secondary winding of the transformer is coupled to two of said four wires via the rectifier and smoothing circuit to provide a dc voltage constituting the low voltage supply for the control unit.

10. The control unit for connection to a transformer unit as claimed in claim 1 via the third connector of the transformer unit for providing said control signal to control a conduction phase angle of the triac in successive half cycles of the waveform of the ac supply, the control unit comprising a connector having at least three wires for coupling to the third connector of the transformer unit, and a control circuit powered by said low voltage supply and responsive to said indication of the timing of the waveform of the ac supply to produce said control signal.

11. The control unit as claimed in claim 10 and including at least one manual control for varying said control signal to vary the conduction phase angle of the triac.

12. The control unit as claimed in claim 10 wherein the control circuit comprises a microcontroller.

13. The control unit as claimed in 12 wherein the control circuit is responsive to initial application of said low voltage supply to produce said control signal to determine a relatively large conduction phase angle of the triac for supplying relatively little power to a load connected to the second connector of the transformer unit, and subsequently to produce said control signal to gradually decrease said conduction phase angle of the triac thereby to gradually increase power supplied to said load.

14. The control unit as claimed in claim 12 and including a display controlled by the microcontroller to constitute a clock.

15. Apparatus comprising:

a first connector for connection to an ac outlet to provide an ac supply;

a second connector constituting an ac outlet;

a triac, the first connector being coupled to the second connector via the triac to provide a controlled ac supply to the second connector;

an electrically isolating coupler for coupling a control signal to the triac for controlling conduction of the triac;

a transformer having primary and secondary windings, the primary winding being coupled to the first connector for receiving the ac supply;

a rectifier and smoothing circuit coupled to the secondary winding of the transformer for providing a dc voltage;

a zero crossing detector arranged to produce a zero crossing signal representing zero crossings of a waveform of the ac supply; and a control circuit powered by the dc voltage and responsive to the zero crossing signal to produce said control signal to control a conduction phase angle of the triac in successive half cycles of the waveform of the ac supply;

wherein at least the first and second connectors, the triac, the electrically isolating coupler, and the transformer are provided in a transformer unit, and at least the control circuit is provided in a control unit separate from the transformer unit for electrical connection to the transformer unit via a third connector having at least three wires, the control unit and the third connector thereby being electrically isolated from the ac supply.

16. Apparatus as claimed in claim 15 wherein the control circuit comprises a microcontroller and is arranged to produce said control signal to determine a conduction phase angle of the triac which is automatically and gradually decreased from a relatively large initial value to a smaller subsequent value, thereby to supply initially relatively little power and subsequently a gradually increasing power to a load connected to the second connector, the control circuit also including at least one manual control to which the microcontroller is responsive for determining said control signal to vary the conduction phase angle of the triac.

17. A transformer unit comprising:

a first connector for connection to an ac outlet to provide an ac supply to the transformer unit;

a second connector constituting an ac outlet of the transformer unit;

a transformer having primary and secondary windings, the primary winding being coupled to the first connector to receive the ac supply;

a third connector comprising at least three wires for connection to a control unit separate from the transformer unit, said at least three wires providing to the control unit a low voltage supply derived from the secondary winding of the transformer and an indication of the timing of a waveform of the ac supply, and providing a control signal from the control unit to the transformer unit; and a controlled device coupled between the first connector and the second connector and responsive to the control signal to provide a controlled ac supply from the first connector to the second connector, the control signal being coupled from the third connector to the controlled device in an electrically isolated manner.

18. A transformer unit as claimed in claim 17 and including a rectifier, the secondary winding of the transformer being coupled to two of said at least three wires via the rectifier to provide a rectified ac voltage to the two wires, the rectified ac voltage constituting said low voltage supply and said indication of the timing of the waveform of the ac supply.

19. A transformer unit as claimed in claim 17 and including a detector arranged to provide a signal representing zero crossings of the waveform of the ac supply and constituting said indication of the timing of the waveform of the ac supply.

20. Apparatus comprising a transformer unit as claimed in claim 17 and a control unit separate from the transformer unit, the control unit comprising a connector having at least three wires for coupling to the third connector of the transformer unit, and a control circuit powered by said low voltage supply and responsive to said indication of the timing of the waveform of the ac supply to produce said control signal to control a conduction phase angle of the controlled device in successive half cycles of the waveform of the ac supply.

* * * * *